US005687908A

United States Patent [19]

Talbert et al.

[11] Patent Number: 5,687,908

[45] Date of Patent: Nov. 18, 1997

[54] NON-CONDENSING DUAL TEMPERATURE COMBINATION SPACE HEATING AND HOT WATER SYSTEM

[75] Inventors: Sherwood G. Talbert, Columbus; Ronald A. Cudnik, Westerville; Jeffrey J. Crisafulli, Columbus, all of Ohio

[73] Assignee: Gas Research Institute, Chicago, Ill.

[21] Appl. No.: 602,636

[22] Filed: Feb. 16, 1996

Related U.S. Application Data

[63] Continuation-in-part of Ser. No. 314,033, Sep. 28, 1994, abandoned.

[51] Int. Cl.[6] ..... F24H 3/02

[52] U.S. Cl. ..... 237/19; 126/101

[58] Field of Search ..... 237/19; 126/101, 126/513, 514

[56] References Cited

U.S. PATENT DOCUMENTS

| | | | |
|---|---|---|---|
| 2,781,174 | 2/1957 | Smith | 237/19 |
| 2,813,683 | 11/1957 | Dillman | 237/19 |
| 3,669,351 | 6/1972 | Meier et al. | 237/19 |
| 3,833,170 | 9/1974 | Marshall | 237/19 |
| 3,999,709 | 12/1976 | Estabrook | 237/19 |
| 4,065,054 | 12/1977 | Meier | 237/19 |
| 4,671,459 | 6/1987 | Stapensea | 237/19 |
| 4,709,854 | 12/1987 | Biagini et al. | 237/19 |
| 4,798,240 | 1/1989 | Gerstmann et al. | 237/19 |
| 5,046,478 | 9/1991 | Clawson | 126/110 R |

*Primary Examiner*—William E. Tapolcai
*Attorney, Agent, or Firm*—Hill, Steadman & Simpson

[57] ABSTRACT

A single system for providing heated water at two different temperature levels for space heating purposes and for domestic water heating purposes is provided. The system can be constructed using only one burner. The system features a first loop for circulating domestic hot water at a lower temperature from an insulated tank, through a first heat exchanger where the water is heated, and back into the insulated tank. The system also features a second loop for circulating space heating water at a different temperature through a second heat exchanger, where the water is cooled, through the first heat exchanger, where the water is heated, and back to the second heat exchanger, where the water is again cooled. A single diverter valve or equivalent is used to determine which heating loop is required and will be activated.

6 Claims, 1 Drawing Sheet

NON-CONDENSING DUAL TEMPERATURE COMBINATION SPACE HEATING AND HOT WATER SYSTEM

This is a continuation-in-part of application Ser. No. 08/314,033, filed Sep. 28, 1994 now abandoned.

FIELD OF THE INVENTION

This invention relates generally to space heaters and water heaters. More specifically, this invention relates to a non-condensing or non-recuperative combination space heating and water heating system that provides water at two different temperatures. Water at a higher temperature, for example, is provided for more effective space heating and water for domestic hot water uses is provided at a lower temperature to avoid scalding. The present invention utilizes potable water for both space heating as well as domestic hot water.

BACKGROUND OF THE INVENTION

The use of hot water for space heating, i.e. conventional boilers, radiators and convectors, is well-known. Further, numerous attempts have been made at combining space heaters and water heaters. However, the known combinations of space heaters and water heaters suffer from two primary deficiencies.

First, the most common types of combination systems operate at a single water temperature. The water cannot be too hot or it is unsafe to use as a source of domestic hot water because water at too high of a temperature presents a danger of scalding. However, safer, lower hot water temperatures (approximately 120° F.) do not provide an effective source of space heat. Thus, the single temperature systems are either too hot for safe domestic hot water purposes or too cold for efficient and comfortable space heating. Second, the known combination space-heating/water-heating systems that do provide water at two temperatures require the use of a boiler with a closed water loop and an additional heating source and are therefore more expensive.

Some condensing or recuperative systems have been provided with limited success. Specifically, U.S. Pat. No. 5,046,478 to Clawson provides a recuperative or condensing space heating and domestic water heating system. The recuperative heat exchanger, or water heater, operates by transferring both sensible heat and heat of condensation from the combustion products to the input water. However, the reliance upon a recuperative heat exchanger has numerous drawbacks. First, a recuperative system requires that the input water be at a low temperature, 90°–100° F. Otherwise, the input water is not cool enough to provide constantly wet surfaces on the outside of the exchange tubes which come in contact with the combustion products. Because the input water temperature must be low (90°–100° F.) and the temperature supplied to the space heater must be in the range of 160°–170° F., the flow rate between the recuperative water heater and the space heater must be limited, which limits the efficiency of both exchangers. Further, the Clawson recuperative heat utilizes a submerged combustion technique which requires a separate blower. Finally, to ensure a low input water temperature, the Clawson system requires a temperature controller, a variable speed pump and a stratified hot water tank. The temperature controller and variable speed pump add to the cost and reduce the reliability of the Clawson system; the stratified hot water tank can be a safety hazard because the consumer uses the hottest water taken from the top of the tank.

Thus, to a limited extent, the prior art has recognized that the employment of separate heating sources for domestic hot water and household space heat is inherently more costly. By employing a separate domestic hot water heater and a separate space heating system, each unit requires separate burners, separate vent systems, and separate controls. If the space heating system includes radiators that are heated with hot water, separate hot water storage tanks and heat exchangers are often required.

The suggested maximum safe temperature for domestic hot water is 120° F. Domestic hot water temperatures above 120° F. pose a danger of scalding, which is an important concern for households with young children or senior citizens. Stratified hot water tanks are dangerous because the water tapped at the top of the tank may be ten or twenty degrees hotter than the water at the bottom of the tank.

However, hot water temperatures below 140° F. are not hot enough to serve as an effective heat source for space heating equipment, such as hydronic coils or radiators. Thus, an ideal combination domestic hot water/space heating system would provide hot water at two temperatures—120° F. for domestic hot water uses and a higher temperature, such as 170° F., for space heating water uses. In terms of energy efficiency, it would also be highly desirable to provide a combination domestic hot water/space heating system that would employ only a single burner and no extra heating sources. However, it would be highly desirable to permit different input water temperatures, i.e. input water from the domestic water tank and input water from the space heater, to the single burner thereby avoiding the disadvantages of a recuperative or condensing system. To provide a cost effective design in terms of the amount of equipment required, it would be highly desirable for the combination system to use potable hot water provided in an open loop system connected to the cold water supply for both the space heating purposes and domestic water heating purposes.

SUMMARY OF THE INVENTION

The present invention satisfies the aforenoted needs by providing a non-condensing, combination, dual temperature, space heating/domestic water heating system that provides water at a higher temperature (e.g. ≈170° F.) for use in space heating and water at a lower temperature (e.g. ≈120° F.) for use as a domestic hot water supply. The system features a single burner and uses the cold water supply for both domestic water heating purposes and for space heating purposes. The system operates at normal cold water supply pressures (e.g. ≈50 psig) and can operate with a wide range of input water temperatures.

The combination space heating and water heating system of the present invention features two distinct hot water loops—one for space heating and one for domestic water heating. The domestic water heating loop includes a cold water input line, which is in communication with or attached to a hot water reservoir or a hot water tank, and a hot water return line which may be connected to the cold water input line or connected directly to the hot water tank. The non-stratified hot water tank includes an outlet line for the domestic hot water and a single warm water supply line connected to the domestic water heating loop. The hot water tank is also connected to a valve in the domestic water heating loop.

The valve, which can be a diverter valve, a 3-way valve, a double-acting valve or two solenoid valves or equivalent valves, or a similar valve that has at least two positions: first, a domestic water heating loop position which permits the pump to circulate water within the water heating loop to the tank, and second, a space heating loop position which permits the pump to circulate heated water within the space heating loop. Thus, when the valve is in the domestic water heating loop position, the valve allows water to flow from the hot water tank to a first heat exchanger and back to the tank. The first heat exchanger, which incorporates a burner, increases the temperature of the water a predetermined amount. For example, warm water departing from the bottom of the hot water tank at 100° F. may be increased a predetermined amount, 20° F., to a final return temperature of 120° F. The heated water leaves the first heat exchanger and proceeds through a tee back to the hot water tank. Warm water departing from the space heater at 160° F. may be increased a predetermined amount, 20° F., to a final return temperature of 180° F. The heated water leaves the first heat exchanger and proceeds through a tee back to the space heater. Water entering the first heat exchanger from the hot water tank need not be at the same or similar temperature as the water entering the first heat exchanger from the space heater.

Of course, different temperature settings will be available for the domestic hot water depending upon the end use and the specific design of the hot water tank and heat exchanger.

The space heating loop, like the domestic water heating loop, includes the valve, pump, first heat exchanger, and tee, but also includes a second heat exchanger which transfers heat from the heated water leaving the first heat exchanger to the circulating room air. Further, the space heating loop bypasses the hot water tank altogether. Warm water departing from the space heater or second heat exchanger at 160° F. may be increased a predetermined amount, 20° F., to a final return temperature of 180° F. The heated water leaves the first heat exchanger and proceeds through a tee back to the space heater or second heat exchanger. Water entering the first heat exchanger from the hot water tank need not be at the same or similar temperature as the water entering the first heat exchanger from the space heater or second heat exchanger.

Therefore, when the valve is in the space heating loop position, the water is heated as it is pumped through the first heat exchanger, then passes through the tee and proceeds on to the second heat exchanger where it loses its heat to the room air. If the second heat exchanger is in the form of a hydronic coil, a blower may be used to enhance the transfer of heat from the heated water within the hydronic coil to the ambient air. The cooler water then leaves the second heat exchanger and proceeds on to the valve. The valve, while in the space heating loop position, enables the cooler water to pass through the valve and be reintroduced into the first heat exchanger where it is reheated. While the space heating loop is circulating, no water is taken from or added to the domestic hot water tank. Therefore, the maximum water temperature in the space heating loop will reach a higher equilibrium temperature, e.g. 170° F., to balance the heat input to the first heat exchanger with the heat output from the second heat exchanger.

One skilled in the art may design the water flow rate and first heat exchanger so that the water leaving the first heat exchanger has been increased about 20° F. before it is reintroduced into the hot water tank or to the space heating heat exchanger. A primary benefit of the present invention is that the space heating loop may be operated at a higher temperature than the domestic hot water tank. Therefore, if an initial water temperature in the second heat exchanger of 170° F. is desired, the second heat exchanger may be designed to reduce that water temperature to 150° F. after which it will be reheated back to 170° F. as it passes through the first heat exchanger. Unlike recuperative or condensing systems, water entering the first heat exchanger from the hot water tank need not be at the same or similar temperature as the water entering the first heat exchanger from the space heater.

Accordingly, the space heating loop may be operated at a higher water temperature (150° F.–180° F.) than the water temperature of the water heating loop (120° F.–140° F.).

The present invention also lends itself to an improved method of providing heated water for both space heating and potable hot water purposes. The method includes aligning the valve, disposed on inlet side of a first heat exchanger, for the mode of heating desired. In the event the potable hot water is to be heated, the valve will be switched to a water heating loop position. As domestic hot water is drawn from the top of the storage tank, cold water is then introduced into the bottom of the hot water reservoir to replenish the water supply contained therein. When the tank thermostat calls for heat, warm water from the bottom area of the storage tank is pumped through the valve and into the first heat exchanger, where it is heated and returned through the tee to the hot water tank. This cycle continues until the temperature in the hot water tank reaches the appropriate setpoint temperature.

In the event space heating is desired, the valve is switched to the appropriate position to provide hot water for space heating. Water is pumped from the first heat exchanger through the tee and into the second heat exchanger where its temperature is reduced and heat from the water is transferred to the room air. Water is pumped from the second heat exchanger through the valve and back into the first heat exchanger where it is reheated before it is pumped back to the second heat exchanger.

An approved method of fabricating a dual temperature combination space heating/water heating system is as follows. A first heat exchanger with a burner is provided. The inlet end of the first heat exchanger is connected to the outlet of a pump, and the inlet end of the pump is connected to the valve having two inlets and a single outlet. The single outlet of the valve is connected to the inlet of the pump. The outlet end of the first heat exchanger is connected to a tee fitting, having two outlets and a single inlet. The single inlet of the tee fitting is connected to the outlet of the first heat exchanger.

One inlet of the valve is connected to a supply outlet of a hot water reservoir; a second inlet of the valve is connected to an outlet of a second heat exchanger. A first outlet of the tee fitting is connected to a return line to the hot water reservoir; a second outlet of the tee fitting is connected to an inlet of a second heat exchanger. The second heat exchanger thereby provides communication between the tee fitting and the valve to complete the space heating loop. However, an alternative arrangement would be to interchange the locations of the valve and the tee fitting, and the overall operation would be the same. Similarly, an alternative arrangement for the pump would be to locate it on the outlet side of the first heat exchanger. The types of valves which could be used include a valve, a 3-way valve, a double-acting valve, or even two separate solenoid valves.

It is therefore an object of the present invention to provide a dual temperature combination space heating and water heating system.

Another object of the present invention is to provide a dual temperature combination space heating and water heating system whereby space heating water is provided at a higher temperature than water for domestic hot water purposes.

Still another object of the present invention is to provide a dual temperature combination space heating and water heating system that utilizes a single burner.

Yet another object of the present invention is to provide a dual-temperature combination space heating and water heating system that provides a space heating system that operates with potable hot water and at municipal water supply pressures.

BRIEF DESCRIPTION OF THE DRAWING

This invention is illustrated more or less diagrammatically in the accompanying drawing, wherein.

Figure 1:
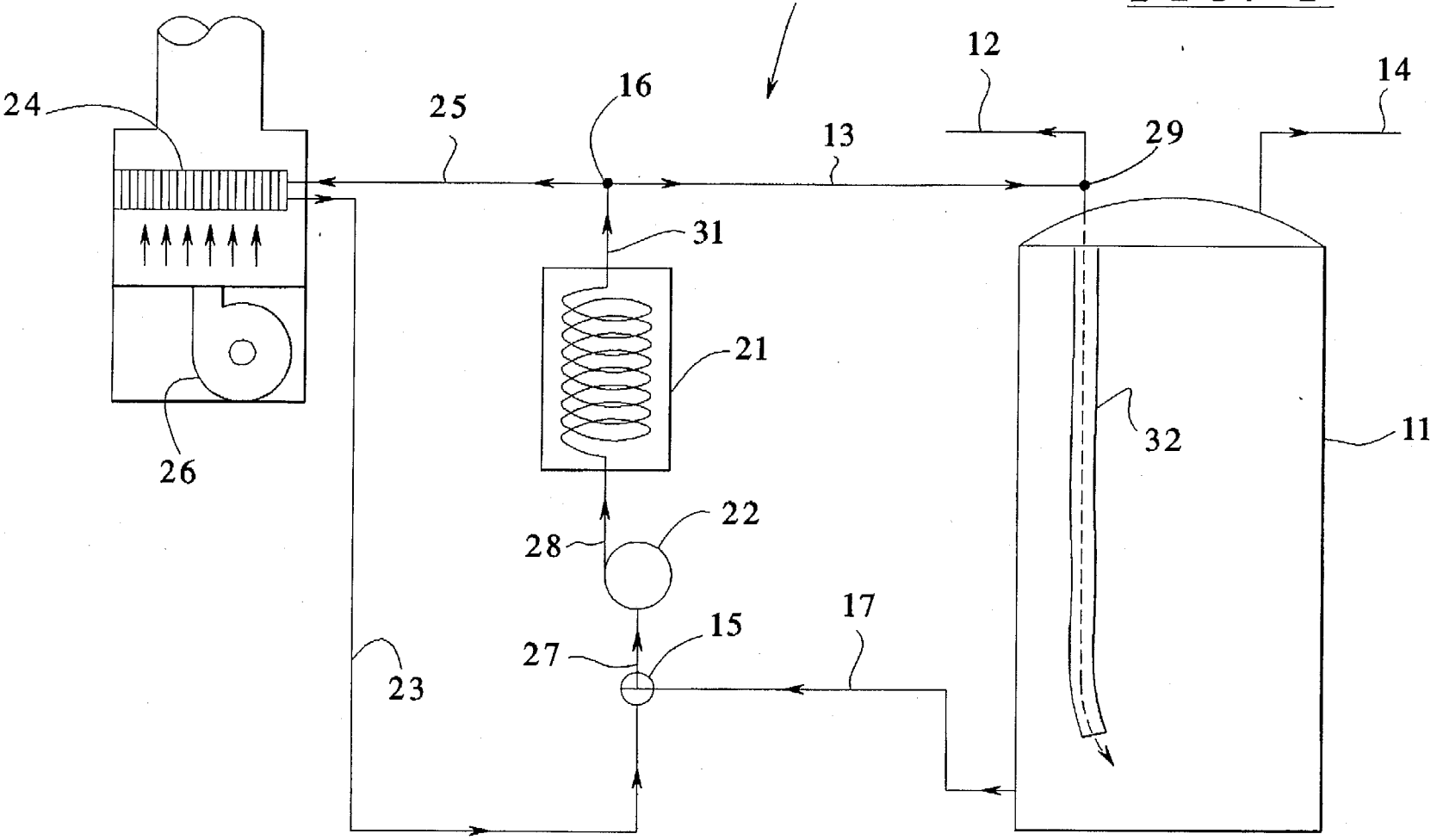
FIG. 1 is a schematic diagram of a dual-temperature combination space-heating/water-heating system made in accordance with the present invention.

It should be understood that FIG. 1 is not necessarily to scale in that the embodiments disclosed therein are illustrated by graphic symbols and/or diagrammatic representations. Details which are not necessary for an understanding of the present invention or which render other details difficult to perceive may have been omitted. It should be understood, of course, that the invention is not necessarily limited to the particular embodiment disclosed herein. For example, the space heating loop could consist of baseboard convectors or a floor heating system, instead of a hydronic fan coil as illustrated. It should be noted also that baseboard convectors would operate at hot water temperatures similar to those for hydronic fan coils, e.g. 170° F., whereas floor heating systems typically operate at hot water temperatures of only 100° F., but this dual temperature combination system could be designed accordingly.

DETAILED DESCRIPTION OF THE INVENTION

Like reference numerals will be used to refer to like or similar parts from Figure to Figure in the following description of the drawing.

FIG. 1 is a schematic diagram of a dual temperature combination space heating/water heating system 10 made in accordance with the present invention. The system features an insulated hot water reservoir or hot water storage tank 11 which is connected to a city water supply line 12 which provides a cold water input for the hot water tank 11. The cold water input line 12 may be also connected to a hot water return line 13 or the hot water return line 13 may be introduced into the tank 11 separately. Domestic hot water exits the tank 11 through the output line 14.

When the temperature of the water inside the hot water tank 11 drops below a predetermined setpoint temperature, the system is switched to the "water heating loop" position whereby the valve 15 is switched so that water is drawn from the tank 11 through the warm water supply line 17 and through the valve 15 before the pump 22 circulates it through the first heat exchanger 21 where it is heated. The heated water is then circulated out of the first heat exchanger 21 where it passes through the tee fitting 16 and into the hot water return line 13 before it is reintroduced into the hot water tank 11.

The first heat exchanger 21 includes a burner or other means for adding heat to the circulating water. The heat exchanger 21 should be a mid-efficiency heat exchanger which is non-condensing. By utilizing a non-condensing/mid-efficiency heat exchanger 21, the efficiency of the heat exchanger 21 is not dependent upon a low water temperature in the incoming line 28. The burner (not shown) could be dual firing or be capable of multiple firing rates or be a modulating burner. Still other types of burners will be apparent to those skilled in the art. If the desired domestic hot water temperature in the tank is 120° F., and hot water is drawn out of the tank 11 through the outlet line 14, cold city water will be drawn into the tank 11 through the cold water input line 12 and the dip tube 32, thereby reducing the temperature of the water in the bottom portion of the tank 11. Accordingly, the valve 15 will be switched to its "water heating loop" position which enables water to flow from the supply line 17 towards the first heat exchanger 21, through the tee fitting 16 to the hot water return line 13 before it is reintroduced into the hot water tank 11.

In the event the room air temperature drops below a predetermined thermostat setting and space heat is required, the system 10 will switch from the "water heating loop" position to the "space heating loop" position. The valve 15 is switched so that the warm water supply line 17 is isolated and water may flow from the outlet line 23 of the second heat exchanger 24 to the first heat exchanger 21. Accordingly, water is circulated from the first heat exchanger 21, through the outlet line 31, through the tee fitting 16, through the input line 25, through the second heat exchanger 24, through the outlet line 23, through the valve 15, through the outlet line 27, through the pump 22, through the inlet 28 and back into the first heat exchanger 21. A fan or blower 26 is provided to increase the rate of heat transfer between the hot water contained within the second heat exchanger 24 and the room air.

The valve 15 or valve means 15 may be provided in a variety of forms including a valve, 3-way valve, double-acting valve or two solenoid valves. The diverter valve 15 is preferably a hydronic, 3-way zone valve which has two inlet lines and one outlet. Other types of suitable valves will be apparent to those skilled in the art. The valve means 15 must be switchable between two positions, i.e. it must be able to provide communication from the reservoir 11 to the first heat exchanger 21 (water heating loop position) or from the second heat exchanger 24 to the first heat exchanger 21 (space heating loop position).

One preferred embodiment for the first heat exchanger 21 is a finned heat exchanger coil surrounding a gas burner. By utilizing a non-condensing and/or mid-efficiency heat exchanger 21 as opposed to a high efficiency condensing heat exchanger at 21, the system 10 does not require a low water temperature at the input line 28 or a large temperature drop across the two heat exchangers 21, 24. One preferred embodiment for the second heat exchanger 24 is a finned hydronic coil in combination with a fan or blower 26. The circulator pump 22 may be disposed between the outlet 27 of the diverter valve 15 and the inlet 28 to the heat exchanger 21. The connection 16 on the outlet line 31 from the first heat exchanger 21, and the connection 29 between the hot water return line 13 and the cold water inlet line 12 may be simple tee fitting connections.

Typically, space heating water should be provided at a much higher temperature than domestic hot water. For example, heated space heating water leaving the first heat exchanger 21 should reach an equilibrium temperature in the range of approximately 170° F. when it is in the input line 25 to the second heat exchanger 24. An effective second heat exchanger 24 will reduce the temperature of the water approximately 20° F. so the water in the outlet line 23 will be approximately 150° F. before it is circulated back to the first heat exchanger 21 to be reheated. In contrast, the domestic hot water in the supply line 17 may be approximately 100° F. before it enters the first heat exchanger 21 where it will be heated to approximately 120° F. before it is recirculated back to the hot water tank 11 where it may be mixed with cold water from the input line 12 if domestic hot water is being drawn from the outlet line 14 at about 120° F. It is important not to provide domestic hot water at temperatures greatly exceeding 120° F. due to the danger of scalding.

Accordingly, a preferred temperature increase across the first heat exchanger 21 is approximately 20° F. with an acceptable temperature increase ranging from 10° F. to 30° F. Temperature increases of less than 10° F. across the first heat exchanger 21 will require excessive liquid flow rates through the system when space heating or water heating is required, and will waste pumping energy. Temperature increases of greater than 30° F. across the first heat exchanger 21 will require restricted flow rates through the second heat exchanger 24 during space heating and may provide domestic hot water at dangerously high temperatures, i.e., >120° F. As noted above, the temperature of the water flowing through the input line 28 to the first heat exchanger 21 is essentially irrelevant and will range from 150° F. or more when water is being returned from the second heat exchanger 24 to 100° F. or less when water is being drawn from the hot water tank 11.

Accordingly, a combination space heating/water heating system is provided with two distinct water circulation loops. A domestic hot water loop provides heated water exiting the heat exchanger 21 at approximately 120° F. The system also provides a space heating loop that provides heated space heating water at the outlet line 31 of the first heat exchanger at approximately 170° F. Thus, the two loops are operated at distinctly different temperatures. The higher temperature is provided in the space heating loop for more effective space heating purposes. The lower temperature is provided in the domestic water heating loop for safety purposes.

Although only one embodiment of the present invention has been illustrated and described, it will at once be apparent to those skilled in the art that variations may be made within the spirit and scope of the invention. Accordingly, it is intended that the scope of the invention be limited solely by the scope of the hereafter appended claims and not by any specific wording in the foregoing description.

We claim:

1. A dual temperature combination space heating and water heating system comprising:

a water heating loop for providing potable domestic hot water at a first water temperature ranging from 120° F. to 140° F., a space heating loop for providing potable space heating water at a second water temperature ranging from 150° F. to 180° F., the potable domestic hot water and potable space heating water being drawn from a common cold water input line, a valve having at least two positions including a water heating loop position and space heating loop position, the water heating loop comprising the common cold water input line in communication with a non-stratified hot water reservoir, a hot water return line in communication with a bottom portion of the hot water reservoir, a warm water supply line providing communication between the hot water reservoir and the valve, the valve, while in the water heating loop position, providing communication between the hot water reservoir and a first heat exchanger, the return line delivering water to the first heat exchanger at a temperature exceeding 120° F. when said valve is in said water heating loop position, the first heat exchanger increasing the temperature of water flowing from the valve to the return line by a first predetermined amount ranging from 10° F. to 30° F., the first heat exchanger directly heating water flowing through the first heat exchanger for both the water heating loop and the space heating loop, the first heat exchanger being a non-condensing/mid-efficiency type heat exchanger, a pump for pumping water in a direction determined by the position of the valve to the first heat exchanger, the space heating loop comprising the valve, while in the space heating loop position, providing communication between the second heat exchanger and a first heat exchanger, the valve delivering water to the first heat exchanger at a temperature exceeding 150° F. when said valve is space heating loop position, the second heat exchanger transferring heat from water passing through the second heat exchanger to room air, the second heat exchanger decreasing the temperature of the water passing through the second heat exchanger by a second predetermined amount ranging from 10° F. to 30° F., the second heat exchanger in communication with the valve.

2. The system of claim 1, wherein the first and second predetermined amounts are about 20° F.

3. The system of claim 1, wherein said pump is a single-speed pump.

4. A dual temperature combination floor heating and water heating system comprising:

a water heating loop for providing potable domestic hot water at a first water temperature ranging from 120° F. to 140° F., a floor heating loop for providing floor heating water at a second water temperature ranging from 80° F. to 100° F., the potable domestic hot water and potable floor heating water being drawn from a common cold water input line, a valve having at least two positions including a water heating loop position and floor heating loop position, the water heating loop comprising the common cold water input line in communication with a non-stratified hot water reservoir, a hot water return line in communication with a bottom portion of the hot water reservoir, a warm water supply line providing communication between the hot water reservoir and the valve, the valve, while in the water heating loop position, providing communication between the hot water reservoir and a first heat exchanger, the return line delivering water to the first heat exchanger at a temperature exceeding 120° F. when said valve is in said water heating loop position, the first heat exchanger increasing the temperature of water flowing from the valve to the return line by a first predetermined amount ranging from 10° F. to 30° F., the first heat exchanger directly heating water flowing through the first heat exchanger for both the water heating loop and the floor heating loop, the first heat exchanger being a non-condensing/mid-efficiency type heat exchanger, a pump for pumping water in a direction determined by the position of the valve to the first heat exchanger, the floor heating loop comprising the valve, while in the floor heating loop position, providing communication between the second heat exchanger and a first heat exchanger, the second heat exchanger transferring heat from water passing through the second heat exchanger to room air, the second heat exchanger decreasing the temperature of the water passing through the second heat exchanger by a second predetermined amount ranging from 10° F. to 30° F., the second heat exchanger in communication with the valve.

5. The system of claim 4, wherein the first and second predetermined amounts are about 20° F.

6. The system of claim 4, wherein said pump is a single-speed pump.

* * * * *